United States Patent [19]

Ward

[11] 4,030,706

[45] June 21, 1977

[54] HIGHWAY GUARD RAIL BUMPER GUARD

[75] Inventor: James S. Ward, Stratford, Conn.

[73] Assignee: James S. Ward, Stratford, Conn.

[22] Filed: Sept. 8, 1976

[21] Appl. No.: 721,465

[52] U.S. Cl. ..... 256/1; 256/13.1; 114/219; 267/140

[51] Int. Cl.[2] ..... E04H 17/00

[58] Field of Search ..... 256/1, 13.1, 19; 114/219, 220; 104/254, 256; 267/140; 293/71 R; 404/6

[56] References Cited

UNITED STATES PATENTS

| | | | |
|---|---|---|---|
| 2,842,085 | 7/1958 | Norman | 114/219 |
| 3,141,655 | 7/1964 | Platt | 256/13.1 X |
| 3,661,359 | 5/1972 | Walker | 256/1 |

FOREIGN PATENTS OR APPLICATIONS

| | | | |
|---|---|---|---|
| 627,915 | 8/1949 | United Kingdom | 114/219 |

*Primary Examiner*—Andrew V. Kundrat
*Attorney, Agent, or Firm*—Andrew Brucker

[57] ABSTRACT

A highway guard rail bumper guard includes at least two automobile tires arranged concentrically one within the other. Each of the tires has a mirror circumferential segment thereof removed to provide each of such tires with a pair of spaced ends. The tires preferably are positioned such that the spaced ends of the respective tires are substantially aligned radially. Fastening means are secured to the outermost of the tires adjacent each of the ends thereof and clamping means is connected between the fastening means. An annularly extending layer of a particulate non-compressible material is disposed within the innermost of the tires.

6 Claims, 3 Drawing Figures

HIGHWAY GUARD RAIL BUMPER GUARD

BACKGROUND OF THE INVENTION

The present invention relates to highway guard rail bumper guards and more particularly to a bumper guard formed of automobile tires.

Impact absorbing devices for attachment to highway and like abutments have been known heretofore for the purpose of protecting both the abutment and the vehicle and its occupants which may collide with the abutment. It has been conventional to employ automobile tires in such devices because of their resiliency and in order to utilize tires which have become worm to the extent that they are no longer of any significant value for their originally intended use on the vehicle. Also, although certain of the prior devices have attempted to enhance the efficacy of the tire by employing a liquid within the tire the prior devices have had only limited value. U.S. Pat. No. 3,661,359 issued May 9, 1972 to Walker Brooks, for example, discloses the use of an automobile tire and rim with a liquid within the tire and with blow out plugs.

SUMMARY OF THE INVENTION

It is one object of the invention to provide a highway guard rail bumper guard having improved impact absorbing capacity.

It is another object of the invention to provide a highway guard rail bumper guard which incorporates a plurality of automobile tires in a unique construction.

Other objects and advantages of the invention will become readily apparent from the following description of the invention.

According to the present invention there is provided a highway guard rail bumper guard comprising; at least two vehicle tires arranged concentrically one within the other, each of the tires having a minor circumferential segment thereof removed to thereby provide spaced ends on each said tire; fastening elements carried by the outermost of the tires adjacent each of the ends thereof; clamping means connected between the fastening elements; and an annularly extending layer of a particulate in compressible material disposed within the innermost of the tires.

BRIEF DESCRIPTION OF THE DRAWINGS

In order that the invention may be more fully comprehended it will now be described, by way of example with reference to the accompanying drawings in which.

DETAILED DESCRIPTION OF THE INVENTION

Figure 1:
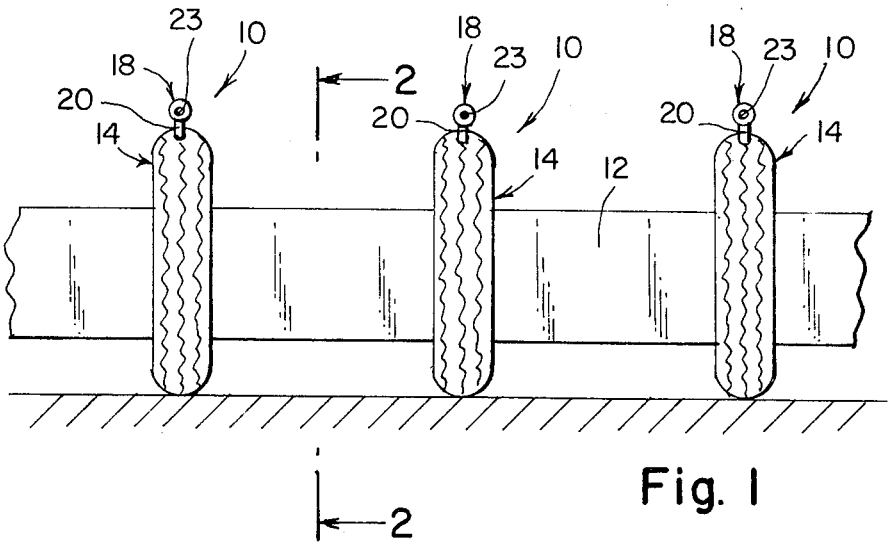
FIG. 1 is a fragmentary front elevational view of a highway guard rail with the bumper guard of the invention mounted thereon.

Referring to the drawings there is shown, as indicated generally by reference numeral 10, a bumper guard so constructed as to be able to absorb a substantial quantity of energy which is developed upon impact of a vehicle therewith. In FIG. 1, a section of a highway guard rail 12 is depicted having three bumper guards of the invention mounted thereon in spaced relation. Desirably the spacing between the bumper guards should be selected such that more than one of the bumper guards will be struck in a head-on collision. A spacing of approximately 4 feet would be satisfactory since most standard size automobiles are of at least this width.

The bumper guard of the invention utilizes at least two vehicle tires 14. Since the existence of tread on the tire is of little or no value in respect to the use of the tire in a bumper guard it is quite satisfactory to utilize tires which have already served their purpose on an automobile. The use of worn tires is indeed preferred since such tires can be obtained at minimal cost and contributes to extending the use of the tires beyond the point at which they would normally be scrapped. It will, of course, be understood that three or more tires may be employed in the construction of the bumper guard although it is presently preferred that only two of such tires be used.

The tires 14 are cut so as to have a minor circumferential segment removed therefrom. Thus, each of the tires is provided with a pair of spaced ends 16. The tires are positioned one within the other concentrically and the outermost of the tires is provided with fastening means which are secured to the tire adjacent each of the ends. As shown in the drawings, the fastening means desirably comprises eyelets 18. The eyelets surmount a shank 20 which is embedded in the outermost tire. A washer or flange 22 on the inner end of the shank serves to retain the eyelet device in place. It will be understood that fastening means other than an eyelet may be used; however, an opening such as is presented by the aperture 23 in the eyelet must be available to permit slidable retention of clamping means to be hereafter described.

The tires used in the construction of the bumper guard may be of the same diametrical size or tires of different sizes may be employed with the diameters increasing progressively from the innermost to the outermost of the tires. In positioning one tire within another it is preferred that the spaced ends of the respective tires be substantially in radial alignment.

Disposed within the innermost of the tires there is an annularly extending layer 24 of an incompresible particulate material. The preferred material is sand because of its low cost and inert chemical characteristics. The material may be placed within an annular bag 26 which is positioned within the carcass of the innermost tire.

Figure 2:
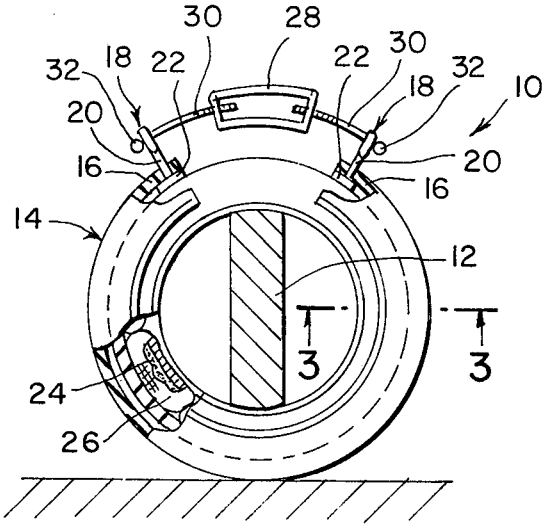
FIG. 2 is a side elevational view, partly in cross-section of a portion of the guard rail and one of the bumper guards shown in FIG. 1 taken along line 2—2 thereof.
Figure 3:
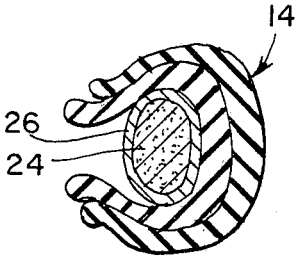
FIG. 3 is a perspective view, in cross-section, of a bumper guard constructed in accordance with the invention.

A clamp 28 is connected to the fastening means 18 when the bumper guard is mounted on the highway guard rail so as to retain the device on the guard rail in the desired position relative thereto. As depicted in FIGS. 1 and 2, the portions of the tires which have been cut should preferably be located at the top of the device. Positioning of the device in this manner leads to greater efficacy for reasons which will become clear. As shown in FIG. 2, the clamp may be of conventional construction, such as a turnbuckle. However, it is desirable that the clamp include a pair of rod elements 30 which are dimensioned so as to be receivable slidably within the fastening elements 18. A retaining member 32, which may simply be an enlargement at the end of each rod, serves to limit the sliding movement of the rods in one direction.

When tires are employed which have different sizes it will be appreciated that there is the possibility of some degree of circumferential slippage between the tires. This is advantageous because upon impact with a vehicle the device absorbs a portion of the force by virtue of the resiliency of the tires, enhanced by the reinforcement of the layer of incompressible material, and a portion of the impact force is absorbed by frictional engagement of the tires at the interface as the tires slide circumferentially relative to each other. The use of the tires in a concentric arrangement leads to a development of the frictional impact absorbing force due to the compression of each outer tire upon the tire disposed next radially inwardly thereof. The use of fastening elements and a clamp having a component such as rods which are slidably related permits the development of the circumferential frictional force between the tires.

From the foregoing it will be seen that a bumper guard has been provided which is relatively simple in construction and which affords the development of unique impact absorbing forces.

I claim:

1. A highway guard rail bumper guard comprising:

at least two vehicle tires arranged concentrically one within the other, each of said tires having a minor circumferential segment thereof removed to thereby provide spaced ends on each said tire;

fastening elements carried by the outermost of said tires adjacent each of the ends thereof;

clamping means connected between said fastening elements; and an annularly extending layer of a particulate incompressible material disposed within the innermost of said tires.

2. A bumper guard according to claim 1, wherein said clamping means are slidably connected between said fastening means.

3. A bumper guard according to claim 2, wherein said fastening elements comprise eyelets and said clamping means includes rod elements slidable within said eyelets.

4. A bumper guard according to claim 1, wherein the diameters of said tires increase progressively from the innermost to the outermost of said tires.

5. A bumper guard according to claim 1, wherein the spaced ends of the respective tires are substantially in radial alignment.

6. A bumper guard according to claim 1, wherein said particulate incompressible material is sand.

* * * * *